US005556009A

United States Patent [19]

Motzko

[11] Patent Number: 5,556,009

[45] Date of Patent: Sep. 17, 1996

[54] ADJUSTABLE CONSTANT PRESSURE CAULK GUN

[75] Inventor: Andrew R. Motzko, Burnsville, Minn.

[73] Assignee: Wagner Spray Tech Corporation, Minneapolis, Minn.

[21] Appl. No.: 275,378

[22] Filed: Jul. 18, 1994

[51] Int. Cl.[6] ..... B65D 88/54

[52] U.S. Cl. ..... 222/326; 222/333; 74/89.15; 192/125 A

[58] Field of Search ..... 222/63, 325, 326, 222/327, 333, 386, 390, 55; 74/89.15; 192/125 A; 239/67–69

[56] References Cited

U.S. PATENT DOCUMENTS

| | | | |
|---|---|---|---|
| 4,024,994 | 5/1977 | Davis, Jr. | 222/390 |
| 4,114,781 | 9/1978 | Doyel | 222/326 |
| 4,257,540 | 3/1981 | Wegmann et al. | 222/327 |
| 4,260,076 | 4/1981 | Bergman | 222/46 |
| 4,335,834 | 6/1982 | Zepkin | 224/63 |
| 4,440,314 | 4/1984 | Vetter et al. | 222/55 |
| 4,522,059 | 6/1985 | Rodde et al. | 222/55 |
| 4,580,698 | 4/1986 | Ladt et al. | 222/55 |
| 4,583,934 | 4/1986 | Hata et al. | 245/376 R |
| 4,615,469 | 10/1986 | Kishi et al. | 222/327 |
| 4,662,540 | 5/1987 | Schroter | 222/55 |
| 4,669,636 | 6/1987 | Miyata | 222/153 |
| 4,789,100 | 12/1988 | Senf | 239/68 |
| 4,804,110 | 2/1989 | Sperry et al. | 222/63 |
| 5,054,650 | 10/1991 | Price | 222/55 |
| 5,105,912 | 4/1992 | Heister | 222/333 |
| 5,182,938 | 2/1993 | Merkel | 73/19.05 |

FOREIGN PATENT DOCUMENTS

| | | | |
|---|---|---|---|
| 2509127 | 1/1983 | France | 239/68 |

OTHER PUBLICATIONS

AEG Power Tool Corporation, Operating Instructions for AEG Rechargeable Variable Speed Cordless Caulking Gun EX581, pp. 1–11.

*Primary Examiner*—Andres Kashnikow
*Assistant Examiner*—Lisa Douglas
*Attorney, Agent, or Firm*—Faegre & Benson

[57] ABSTRACT

An adjustable, battery-powered, constant pressure gun for dispensing viscous materials such as caulk and adhesive. The gun includes a housing having a handle, an operator-actuated trigger, and a battery compartment with power supply terminals. A motor mounted within the housing drives a dispensing mechanism. The flow of current through the motor is controlled by an electronic switch. A current-to-voltage converter including a low-pass filter is coupled to the motor and provides a feedback pressure signal representative of the actual dispensing pressure as a function of the current drawn by the motor. A set-point voltage signal representative of a desired dispensing pressure is provided by an operator-adjustable pressure control. A hysteresis comparator connected to the electronic switch compares the feedback pressure signal to the set-point signal, and controls the switch as a function of the comparison to maintain the actual dispensing pressure within a predetermined operating band of the desired dispensing pressure when the trigger is actuated.

18 Claims, 4 Drawing Sheets

ADJUSTABLE CONSTANT PRESSURE CAULK GUN

BACKGROUND OF THE INVENTION

1. Field of the Invention

The present invention relates generally to devices, commonly referred to as caulk guns, for dispensing caulk, adhesive and other viscous materials. In particular, the present invention is a battery-powered, adjustable, constant pressure caulk gun.

2. Description of the Related Art

Battery-powered caulk guns of the type used to dispense viscous fluids such as caulk and adhesive are generally known and disclosed, for example, in the following U.S. Patents.

| Inventor | U.S. Pat. No. |
|---|---|
| Hata et al. | 4,583,934 |
| Kishi et al. | 4,615,469 |
| Miyata | 4,669,636 |

These caulk guns are configured for use with commercially available tubes of fluid material, and include a motor coupled to a plunger. The motor is controlled by a trigger-actuated switch. Pulling the trigger closes the switch and electrically interconnects the motor to the batteries. The plunger is thereby driven into the tube to pressurize and dispense the fluid material.

The trigger must be periodically pulled and released to maintain a relatively constant fluid material dispensing rate while using caulk guns of the type described above. In practice, it can be difficult to control the dispensing rate in this manner. This problem is compounded by the fact that the different fluid materials that are commonly dispensed by these guns can have a wide range of viscosities. There is, therefore, a continuing need for improved electric caulk guns.

SUMMARY OF THE INVENTION

The present invention is an adjustable, constant pressure gun for dispensing viscous materials such as caulk and adhesive. The gun includes a housing having a handle, an operator-actuated trigger, and power supply terminals for interconnection to a source of electrical power. A dispensing mechanism and associated drive motor are mounted within the housing. An electronic switch is connected between the power supply terminals and motor to control the flow of current through the motor. An operator-actuated pressure control provides a desired pressure signal representative of a desired dispensing pressure. A feedback pressure circuit coupled to the motor provides a feedback pressure signal representative of the actual dispensing pressure as a function of the load on the motor. A comparator compares the feedback pressure signal to the desired pressure signal, and controls the electronic switch as a function of the comparison to maintain the actual dispensing pressure within a predetermined operating band of the desired dispensing pressure while the trigger is pulled.

DETAILED DESCRIPTION OF THE PREFERRED EMBODIMENTS

Figure 1:
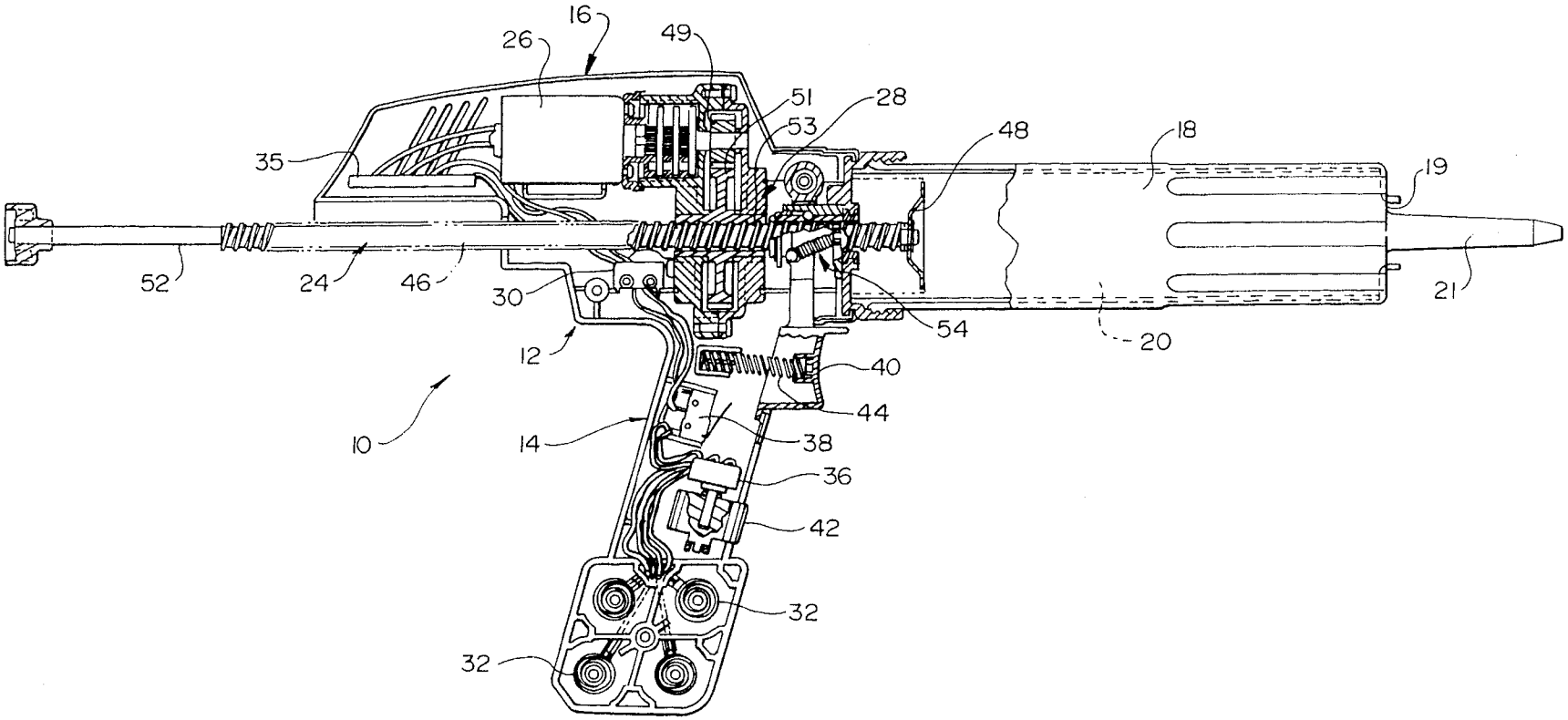
FIG. 1 a sectional view taken from the side of a battery-powered, adjustable, constant pressure caulk gun in accordance with the present invention.

A battery-powered, adjustable, constant pressure caulk gun 10 in accordance with the present in invention is illustrated generally in FIG. 1. As shown, caulk gun 10 includes a pistol-shaped housing 12 with a handle 14 and drive enclosure 16, and a sleeve 18 which extends from the drive enclosure. Sleeve 18 is a hollow member sized to receive commercially available tubes 20 of caulk, adhesive and other viscous materials, and includes an aperture 19 through which the nozzle 21 of tube 20 projects. The end of sleeve 18 opposite aperture 19 includes threads for removably mounting the sleeve to housing 12. Components of caulk gun 10 mounted within drive enclosure 16 include drive rod 24, DC motor 26, drive linkage 28, end-of-rod switch 30 and pressure control circuit 35. Batteries 32, enable/pressure control 36 and motor switch 38 are mounted within handle 14. A finger-actuated trigger 40 is mounted to the forward side of handle 14. Operator-actuated knob 42 of enable/pressure control 36 also extends from the forward side of handle 14.

Drive rod 24 includes a threaded portion 46 which extends through drive linkage 28, and a pressure plate 48 on the end of the threaded portion. Drive rod 24 also includes an unthreaded portion 52 on the end opposite pressure plate 48. Pressure plate 48 is positioned within sleeve 18 and sized to engage a piston (not shown) within viscous material tube 20. Drive linkage 28 includes a pinion gear 49 driven by the drive shaft of motor 26, and a drive gear 51 concentrically mounted about drive rod 24 for rotation by the pinion gear. A clutch 53 is mechanically connected to trigger 40 by linkage 54, and causes drive gear 51 to engage threaded portion 46 of drive rod 24 when actuated by the trigger. When the drive linkage 28 is engaged with drive rod 24, the drive linkage translates the rotary motion of motor 26 into linear motion of the drive rod. Pressure plate 48 is thereby forced into tube 20 causing the viscous material to be dispensed through nozzle 21. When drive linkage 28 is disengaged from drive rod 24, the drive rod can be manually moved toward and away from tube 20.

In addition to actuating the clutch 53 of drive linkage 28, trigger 40 actuates motor switch 38 to control motor 26. As illustrated in FIG. 1, trigger 40 is biased outwardly by spring 44 to a normal, unactuated Off position. As trigger 40 is pulled from the Off position, it passes through a Partial On position before engaging motor switch 38 and having its motion stopped at a Full On position. Drive linkage 28 and linkage 54 are configured in such a manner that the drive linkage is disengaged from drive rod 24 when the trigger is in the Off position. Motor switch 38 is in an electrically open state (switched Off) when trigger 40 is at the Off position, thereby electrically disconnecting batteries 32 from motor 26 and power supply 34. Motor 26 is therefore off, and drive linkage 28 disengaged from drive rod 24, when trigger 40 is in its Off position.

Figure 2:
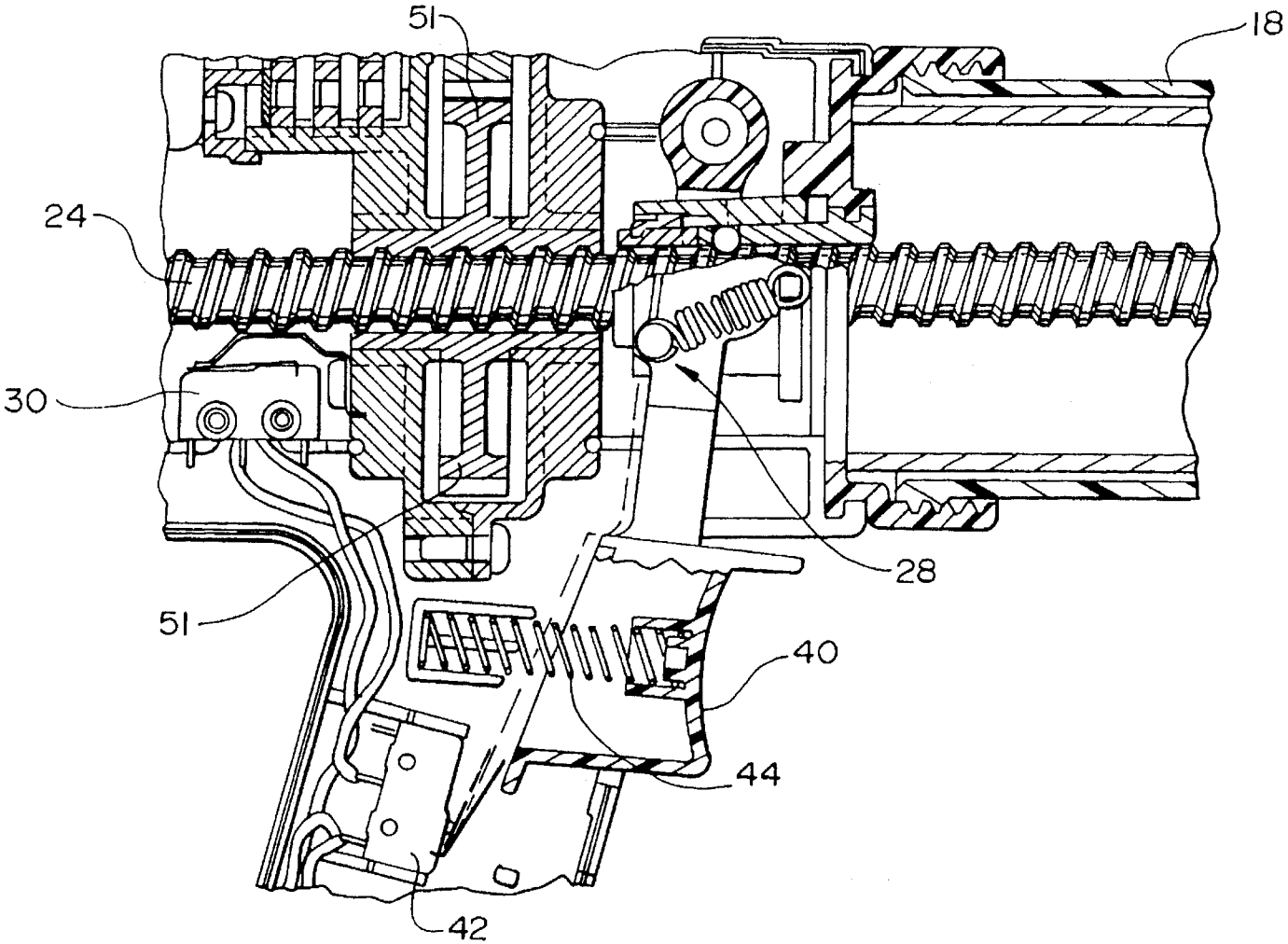
FIG. 2 is a detailed view of the trigger and motor switch shown in FIG. 1.

As shown in FIG. 2, drive linkage 28 and linkage 54 are configured in such a manner that the drive linkage is engaged with drive rod 24 when trigger 40 is in the Partial On position. However, motor switch 38 remains switched Off when trigger 40 is in the Partial On position. Motor 26 is therefore off, and drive linkage 28 engaged with drive rod 24, when trigger 40 is in its Partial On position.

Trigger 40 engages motor switch 38 when the trigger is pulled to its Full On position (shown by broken lines in FIG. 2). When engaged by trigger 40 in this manner, motor switch 38 is forced to an electrically closed state (switched On) to electrically interconnect batteries 32 to motor 26 and pressure control circuit 35. Drive linkage 28 remains engaged with drive rod 24 when trigger 40 is in the Full On position. As described in greater detail below, both motor switch 38 and enable/pressure control 36 must be switched On to actuate motor 26. If the enable/pressure control 36 is switched On, motor 26 is engaged with and will move drive rod 24 when trigger 40 is pulled to the Full On position.

Enable/pressure control 36 functions both as a enable switch and a pressure control adjusting switch. When switched to the Off position, enable/pressure control 36 electrically disconnects batteries 32 from pressure control circuit 35 and motor 26 to disable the operation of caulk gun 10. When switched from the Off position to an initial On position, enable/pressure control 36 electrically interconnects batteries 32 to pressure control circuit 35 and motor 26, and enables the operation of caulk gun 10 through trigger 40. After enable/pressure control 36 is switched to the initial On position, the switch can be further actuated to adjust the maximum pressure at which caulk gun 10 operates. Enable/pressure control 36 controls pressure control circuit 35 in such a manner that caulk gun 10 will be set to operate at a minimum pressure setting when switched from the Off position to the initial On position. The pressure setting of caulk gun 10 can then be increased by further rotation of enable/pressure control 36 from the initial On position, to a maximum pressure at the final On position of the switch.

An operator prepares caulk gun 10 for use by removing sleeve 18 and inserting a tube 20 of viscous material into the sleeve. Sleeve 18 is then resecured to the end of drive enclosure 16 to hold the tube 20, and drive rod 24 manually pushed toward the tube to engage pressure plate 48 with the tube piston. While holding caulk gun 10 at handle 14, the operator will turn knob 42 of enable/pressure control 36 to enable the operation of the gun, and set the knob at a position between the initial and final On positions that approximates the pressure at which the operator desires to operate the gun. The operator then pulls trigger 40 from the Off position to the Full On position to force drive rod 24 and pressure plate 48 into tube 20 and thereby dispense the viscous material from nozzle 21.

When trigger 40 is first pulled to the Full On position after a new tube 20 is loaded into gun 10, pressure control circuit 35 causes the drive rod 24 to be driven at full speed to bring the dispensing pressure to the value set by enable/pressure control 36 as quickly as possible. As described in greater detail below, pressure control circuit 35 senses the current being drawn by motor 26 to determine the dispensing pressure, and controls the operation of motor 26 while trigger 40 is pulled to the Full On position to maintain the dispensing pressure within a predetermined and relatively narrow operating pressure band of the value set by enable/pressure control 36. The operator will also typically observe the rate at which the viscous material is dispensed from nozzle 21 before applying the material after a new tube 20 is loaded into gun 10. Enable/pressure control 36 can then be actuated to set the dispensing pressure to a desired level.

As long as the operator keeps trigger 40 pulled to the Full On position, caulk gun 10 will dispense the viscous material within the operating pressure band of the pressure set by enable/pressure control 36. When the operator desires to discontinue dispensing viscous material from tube 20, trigger 40 is released and allowed to move to the Off position. Since motor 26 is stopped and drive linkage 28 is disengaged from drive rod 24, pressure plate 48 will no longer apply pressure to the piston of tube 20. Viscous material will therefore stop flowing from nozzle 21 almost immediately when trigger 40 is released and allowed to return to the Off position.

The operator of caulk gun 10 will occasionally desire to temporarily dispense the viscous material at a flow rate lower than the flow rate occurring at the dispensing pressure set by enable/pressure control 36, as for example when dispensing the material around a corner. To obtain this mode of operation with caulk gun 10, the operator releases trigger 40 from the Full On position and holds the trigger at the Partial On position. As described above, motor 26 is turned off when trigger 40 is at the Partial On position, but drive linkage 28 is still engaged with drive rod 24. Since pressure plate 48 is not released from the piston of tube 20 when trigger 40 is at the Partial On position, the pressure within the tube will slowly dissipate as viscous material continues to flow from nozzle 21. This slow dissipation of pressure when trigger 40 is released from the Full On position to the Partial On position results in a continuous slowing of the rate at which the viscous material is dispensed.

End-of-rod switch 30 is mounted within enclosure 16 and positioned with respect to drive rod 24 in such a manner that the end-of-rod switch will switch between electrically closed and open states when the drive rod has reached the end of its operational range of travel. The diameter of threaded portion 46 of drive rod 24 is greater than the diameter of unthreaded portion 52. While drive rod 24 is within its operational range of travel (i.e, capable of dispensing viscous material from tube 20), end-of-rod switch 30 is engaged by the threaded portion 46 of drive rod 24 and switched On to its electrically closed state. End-of-rod switch 30 enables the control of motor 26 by trigger 40 and enable/pressure control 36 in the manner described above while switched On. When drive rod 24 reaches the end of its operational range of travel, unthreaded portion 52 of drive rod 24 is positioned adjacent to end-of-rod switch 30, thereby causing the end-of-rod switch to switch to its electrically open or Off state and disable the control of motor 26 by trigger 40 and enable/pressure control 36.

Figure 3:
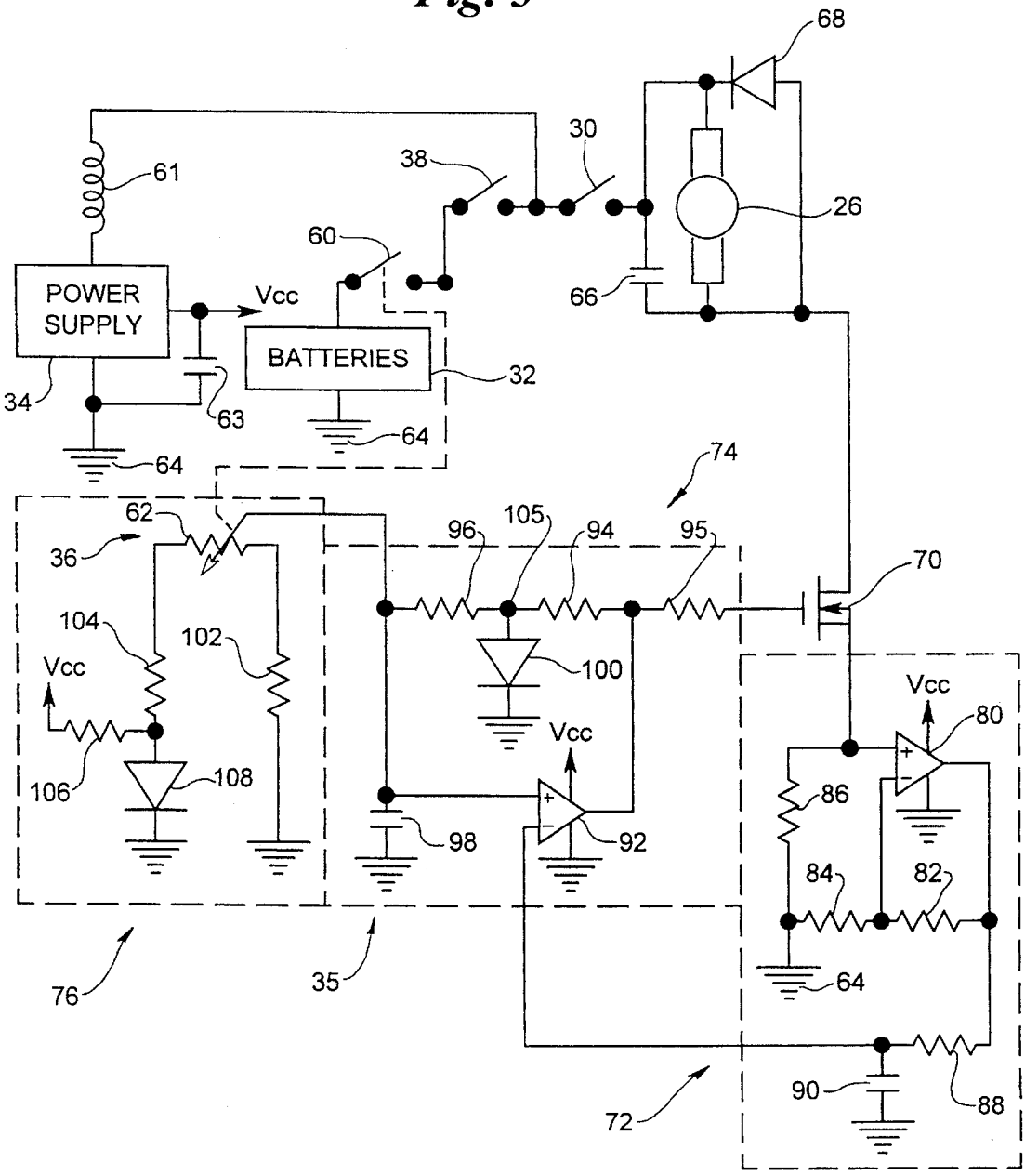
FIG. 3 is a detailed schematic diagram of the motor control circuit shown in FIG. 1, and its interconnection to the motor, power supply, battery, enable/pressure control switch and trigger switch.

Pressure control circuit 35 and its interconnections to motor 26, end-of-rod switch 30, batteries 32, enable/pressure control 36 and motor switch 38 can be described in greater detail with reference to FIG. 3. As shown, enable/pressure control 36 includes mechanically linked enable switch 60 and potentiometer 62, both of which are actuated by knob 42 (FIG. 1). A first terminal of batteries 32 is connected to ground 64. A second terminal of batteries 32 is connected to a first terminal of motor 26 through the series connection of enable switch 60, motor switch 38 and end-of-rod switch 30. Pressure control circuit 35 includes a power supply 34. A first terminal of power supply 34 is connected to ground 64, and a second terminal is connected to batteries 32 through the series connection of inductor 61, enable switch 60 and motor switch 38. The output terminal of power supply 34 is connected to ground 64 through bypass capacitor 63. When enable switch 60 and motor switch 38 are both switched On, batteries 32 are electrically interconnected to power supply 34. In response, power supply 34 generates the Vcc supply potential used by the other components of pressure control circuit 35. Bypass capacitor 66 and diode 68 are connected between the first and second terminals of motor 26. The anode of diode 68 is connected to the first terminal of motor 26, and the cathode is connected to the second terminal.

In addition to power supply 34, pressure control circuit 35 includes MOSFET 70, current-to-voltage (I/V) converter 72, comparator 74 and resistor ladder 76. I/V converter 72 includes operational amplifier 80, resistors 82, 84, 86 and 88, and capacitor 90. The noninverting (+) input terminal of operational amplifier 80 is connected directly to the source of MOSFET 70, and to ground 64 through resistor 86. The inverting (−) input terminal of operational amplifier 80 is connected to ground 64 through resistor 84, and to the output terminal of the operational amplifier through resistor 82. The output terminal of operational amplifier 80 is connected to ground 64 through the series connection of resistor 88 and capacitor 90. The drain of MOSFET 70 is connected to the second terminal of motor 26.

Comparator 74 includes operational amplifier 92, resistors 94, 95 and 96, capacitor 98 and diode 100. The inverting (−) input terminal of operational amplifier 92 is connected to the node between resistor 88 and capacitor 90 to receive the output signal generated by I/V converter 72. The output terminal of operational amplifier 92 is connected to the gate of MOSFET 70 through resistor 95. The noninverting (+) input terminal of operational amplifier 92 is connected to the output terminal of the operational amplifier through the series connection of resistors 94 and 96. The node between resistors 94 and 96 is connected to ground 64 through diode 100, with the cathode of the diode connected to the node and the anode connected to ground. The noninverting (+) input terminal of operational amplifier 92 is connected to ground 64 through capacitor 98. The noninverting (+) input terminal of operational amplifier 92 is also connected to the adjustable center tap terminal of potentiometer 62 of enable/pressure control 36. Resistor ladder 76 includes potentiometer 62, resistors 102, 104 and 106, and diode 108. Resistor 102 is connected between ground 64 and a first terminal of potentiometer 62 of enable/pressure control 36. A second terminal of potentiometer 62 is connected to ground 64 through resistor 104 and diode 108, with the anode of the diode connected to ground. The node between resistor 104 and diode 108 is connected to receive the Vcc supply potential through resister 106. The part number or value of the components of one embodiment of pressure control circuit 35 are listed below.

| Component | Part Number/Value |
|---|---|
| Power Supply 34 | Max 632 (available from Maxim Integrated Products of Sunnyvale, CA) |
| Inductor 61 | 330 μH |
| Potentiometer 62 | 50K Ω |
| Capacitor 63 | 22 μf |
| Capacitor 66 | 0.1 μf |
| Diode 68 | 1N4004 |
| MOSFET 70 | IRLZ44 |
| Op-Amp 80 | LM 324 |
| Resistor 82 | 220K Ω |
| Resistor 84 | 10K Ω |
| Resistor 86 | 0.01 Ω |
| Resistor 88 | 33K Ω |
| Capacitor 90 | 10 μf |
| Op-Amp 92 | LM 324 |
| Resistor 94 | 10K Ω |
| Resistor 95 | 33K Ω |
| Resistor 96 | 270K Ω |
| Capacitor 98 | 1000 pf |

-continued

| Component | Part Number/Value |
|---|---|
| Diode 100 | 1N4148 |
| Resistor 102 | 33K Ω |
| Resistor 104 | 10K Ω |
| Resistor 106 | 10K Ω |
| Diode 108 | 1N4148 |

The amount of current drawn by DC motor 26 while the motor is operating is proportional to the torque being generated by the motor. In caulk gun 10, the amount of torque being generated by motor 26 is directly proportional to the pressure exerted by pressure plate 48 on the piston of tube 20 (i.e., the motor load). The amount of current flowing through motor 26 is therefore directly related to the actual pressure at which the viscous material is being dispensed from tube 20. Pressure control circuit 35 monitors the amount or magnitude of current flowing through motor 26, and switches the motor on and off as a function of the monitored current and the desired pressure level selected through enable/pressure control 36, to maintain the pressure relatively constant at the selected pressure. In particular, pressure control circuit 35 maintains the pressure exerted by pressure plate 48 within a relatively narrow window or operating pressure band of the selected pressure. The following is a detailed description of the manner by which pressure control circuit 35 maintains relatively constant pressure on the viscous material within tube 20 when switch 60 of enable/pressure control 36 is On, drive rod 24 is within its operational range of motion and end-of-rod switch 30 is closed, and trigger 40 is pulled to its Full On position so motor switch 38 is On.

MOSFET 70 is actuated by comparator 74 and functions as a switch to control the flow of current through motor 26. When the output of comparator 74 (i.e., the output of operational amplifier 92) is at a logic Low state, a relatively low voltage is applied to the gate of MOSFET 70. Under this operating condition, MOSFET 70 is switched Off, thereby preventing the flow of current through motor 26 and switching the motor Off. When the output of comparator 74 is at a logic High state, a relatively high voltage is applied to the gate of MOSFET 70, thereby switching the MOSFET On. When MOSFET 70 is switched On, a current flow path is established from batteries 32 to ground 64 through motor 26, the MOSFET and resistor 86.

Figure 4:
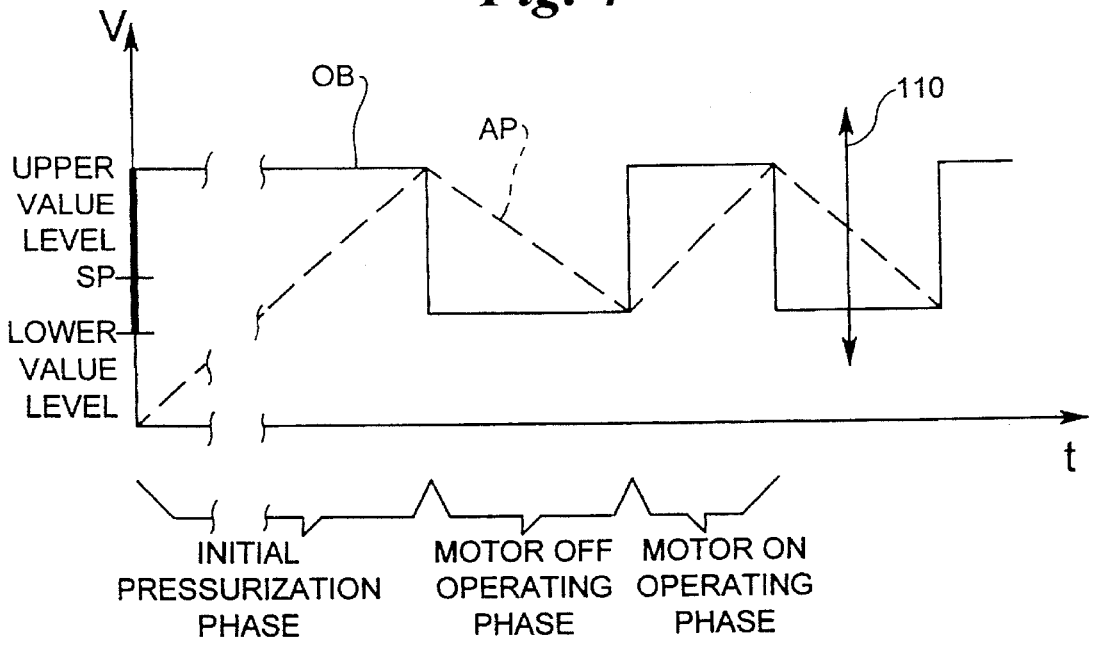
FIG. 4 is a diagram illustrating the switching operation of the comparator shown in FIG. 3.

Operational amplifier 80 and resistors 82, 84 and 86 are configured as a current-to-voltage converter. When MOSFET 70 and motor 26 are switched On, a voltage signal having a magnitude proportional to the magnitude of the current flowing through motor 26, and therefore proportional to the actual pressure applied to viscous material tube 20, is generated at the output of operational amplifier 80. The voltage signal outputted by operational amplifier 80 is averaged by the low-pass filter formed by resistor 88 and capacitor 90 to generate a feedback pressure signal AP which is illustrated in FIG. 4. Feedback pressure signal AP is applied to comparator 74 through the inverting (−) input terminal of operational amplifier 92. Feedback pressure signal AP is proportional to the actual pressure applied to viscous material tube 20 by pressure plate 48 (i.e., to the actual dispensing pressure).

Comparator 74 functions as a hysteresis comparator, and compares the feedback pressure signal AP to an operating band signal OB that is representative of a selected operating band pressure. As shown in FIG. 4, the operating band signal 0B switches between an upper value level and a lower value level. The operating pressure band is a relatively narrow window or range of pressures approximately centered about a set-point pressure (SP), with the maximum pressure of the band represented by the upper level value of operating band signal OB, and the minimum pressure of the band represented by the lower level value of signal OB. Operating band signal OB is representative of the pressure window within which the pressure applied to tube 20 by pressure plate 48 is maintained by pressure control circuit 35. By adjusting potentiometer 62, an operator can raise and lower the set-point pressure and operating band signal as illustrated by line 110 in FIG. 4, thereby raising and lowering the pressure applied to tube 20 by caulk gun 10.

Potentiometer 62 of enable/pressure control 36 and resistor ladder 76 function as an adjustable voltage source, and cooperate with comparator 74 to generate a set-point voltage representative of the desired pressure to be applied by pressure plate 48 (i.e., the set-point pressure). The set-point voltage from the center tap of potentiometer 62 is applied to the noninverting (+) input terminal of operational amplifier 92. The operator of caulk gun 10 can adjust potentiometer 62 to raise and lower the set-point voltage, and therefore the desired operating pressure of the caulk gun. Since pressure control circuit 35 is battery powered, the supply potential Vcc can vary during the operation of caulk gun 10. Resistor 106 and diode 108 are therefore used to generate a relatively constant reference voltage of about 0.65 volts (one diode voltage drop) at the node 105 between resistors 104 and 106.

Resistors 94 and 96 and diode 100 of comparator 74 are connected in a positive feedback arrangement between the output and noninverting (+) input terminals of operational amplifier 92 to generate the operating band voltage signal OB. When the output of operational amplifier 92 is at a logic High state, resistor 94 and diode 100 function as a voltage reference and provide a relatively constant and stable voltage of about 0.65 volts (i.e., one diode voltage drop) at the node between resistors 94 and 96. Resistor 96 is therefore interconnected in a parallel circuit with the series combination of resistor 104 and the resistive portion of potentiometer 62 between resistor 104 and the noninverting (+) input terminal of operational amplifier 92. By switching resistor 96 into this parallel circuit, the magnitude of the signal applied to the noninverting (+) input terminal of operational amplifier 92 is effectively raised above the set-point voltage that otherwise would have been established by resistor ladder 76 alone, to the upper valve level of operating band signal OB.

When the output of operational amplifier 92 is at a logic Low state, the series combination of resistors 94 and 96 is effectively connected in a parallel circuit with the series combination of resistor 102 and the resistive portion of potentiometer 62 between resistor 102 and the noninverting (+) input terminal of operational amplifier 92. By switching resistors 94 and 96 into this parallel circuit, the magnitude of the signal applied to the noninverting (+) input terminal of operational amplifier 92 is effectively lowered below the set-point voltage that otherwise would have been established by resistor ladder 76 alone, to the lower value level.

Operational amplifier 92 compares the feedback pressure voltage signal AP applied to its inverting (−) input terminal to the upper value level and lower value level of the operating band voltage signal OB, and controls MOSFET 70 as a function of the comparison so as to maintain the pressure applied to tube 20 within the selected operating pressure band. Before trigger 40 is pulled from the Off position to the Full On position, such as after a new tube 20 is loaded into caulk gun 10 or after the caulk gun has been unused for a period of time, the drive linkage 28 is disengaged from push rod 24. Pressure plate 48 will therefore be exerting little if any pressure on the tube. When trigger 40 is pulled to the Full On position during this Initial Pressurization Phase, the feedback pressure signal AP applied to the inverting (−) input terminal of operational amplifier 92 will be equal to about zero, while the operating band voltage signal OB applied to the noninverting (+) input terminal will initially be at the lower value level but which will still be greater than the feedback pressure signal. Since the feedback pressure signal AP is less than the desired pressure represented by the level of signal OB at this time, the output terminal of operational amplifier 92 switches to a logic High state, thereby turning On MOSFET 70 and motor 26 in the manner described above. With no initial pressure applied to tube 20 at the beginning of the Initial Pressurization Phase, motor 26 will drive pressure plate 48 toward tube 20 at full speed. As pressure plate 48 engages the piston of tube 20 and pushes the piston into the tube to build up pressure within the tube, the feedback pressure signal AP generated by I/V converter 72 increases proportionally as shown in FIG. 4.

When the magnitude of the feedback pressure signal AP reaches the upper value level of signal OB at the end of the Initial Pressurization Phase, the output terminal of operational amplifier 92 switches to a logic Low state, thereby turning Off MOSFET 70 and motor 26 in the manner described above and beginning the Motor Off Operating Phase. With the output of operational amplifier 92 switched to its Low logic state, the lower value level of the operating band signal OB is applied to the noninverting (+) input terminal of the operational amplifier during the Motor Off Operating Phase. Furthermore, since motor 26 is Off, the output of operational amplifier 80 will be close to zero, and the feedback pressure signal AP will decrease. The rate at which feedback pressure signal AP decreases is determined by the time constant of the RC filter formed by capacitor 90 and resistor 88.

When the magnitude of the feedback pressure signal AP reaches the lower value level of signal OB at the end of the Motor Off Operating Phase, the output terminal of operational amplifier 92 switches to a logic High state, thereby turning On MOSFET 70 and motor 26 to begin the Motor On Operating Phase. With the output of operational amplifier 92 switched to its logic High state, the upper value level of operating band signal OB is applied to the noninverting (+) input terminal of the operational amplifier during the Motor On Operating Phase. Feedback pressure signal AP will then rise until it reaches the upper value level, and the Motor Off Operating Phase is repeated in the manner described above. As long as trigger 40 is pulled to the Full On position, pressure control circuit 35 will continue to switch motor 26 On and Off in the manner described above to maintain the dispensing pressure within the pressure operating band of the set-point pressure.

The embodiment of caulk gun 10 described above is configured for use with four, one and one-half volt alkaline batteries 32. In another embodiment (not shown) caulk gun 10 is configured for use with four rechargeable, one and two tenths volt NiCd batteries in series. In this alternate embodiment, the Vcc supply potential is provided directly from batteries 32, and the caulk gun does not include circuitry functioning as the power supply 34 or associated circuit elements 61 and 63. Resistors 94 and 106 are also 3.3 KΩ resistors in this alternate embodiment. Other than these differences, the caulk gun configured for use with rechargeable NiCd batteries is identical to caulk gun 10 described above.

Caulk gun 10 including pressure control circuit 35 offers considerable advantages. By operating trigger 44 and enable/pressure control 36, the operator can conveniently and easily operate the caulk gun and select an appropriate operating pressure. Pressure control circuit 35 will then accurately maintain the pressure at the selected level. Caulk gun 10 is also reliable and efficient to manufacture.

Although the present invention has been described with reference to preferred embodiments, those skilled in the art will recognize than changes may be made in form and detail without departing from the spirit and scope of the invention.

What is claimed is:

1. A motor control circuit adapted for controlling the pressure at which viscous materials such a caulk and adhesive are dispensed from a caulk gun, including:

an electronic switch adapted for controlling the flow of current through a caulk gun motor;

a feedback pressure circuit adapted for providing a feedback pressure signal representative of the actual pressure at which viscous materials are dispensed from the caulk gun, including load means adapted for interconnection to the motor for providing the feedback pressure signal as a function of the load on the motor;

an operator-adjustable pressure control adapted for providing a set-point pressure signal representative of a desired pressure for dispensing viscous materials from the caulk gun; and a comparator connected to the electronic switch, feedback pressure circuit and pressure control, for comparing the feedback pressure signal to the set-point pressure signal, and adapted for controlling the switch as a function of the comparison to maintain the actual pressure at which the viscous materials are dispensed within a predetermined operating pressure band of the desired pressure.

2. The motor control circuit of claim 1 wherein:

the load means includes:

a current-to-voltage converter adapted for interconnection to the motor for providing a feedback pressure voltage signal representative of the current drawn by the caulk gun motor;

the pressure control includes:

an operator-adjustable reference voltage source for providing a set-point voltage representative of the desired operating pressure band; and the comparator compares the feedback pressure voltage signal to the set-point voltage, and controls the electronic switch as a function of the comparison.

3. The motor control circuit of claim 2 wherein:

the pressure control includes:

an operator-adjustable potentiometer for adjusting the set point voltage.

4. The motor control circuit of claim 2 wherein:

the comparator includes:

means for turning on the electronic switch to allow current flow through the caulk gun motor when the feedback pressure voltage signal is less than the set-point voltage; and means for turning off the electronic switch to prevent current flow through the caulk gun motor when the feedback pressure voltage signal is greater than the set-point voltage signal.

5. The motor control circuit of claim 4 wherein:

the electronic switch is adapted to be connected between the caulk gun motor and the comparator.

6. The motor control circuit of claim 2 wherein:

the comparator includes:

a hysteresis comparator.

7. The motor control circuit of claim 6 wherein:

the hysteresis comparator includes:

an operational amplifier having an output terminal connected to the electronic switch, a noninverting input terminal connected to the pressure control to receive the set-point voltage, and an inverting input terminal connected to the current-to-voltage converter to receive the feedback pressure voltage signal; and positive feedback circuitry connected between the output and input terminals of the operational amplifier and cooperating with the pressure control to establish the operating pressure band.

8. The motor control circuit of claim 7 wherein:

the pressure control includes:

an operator-adjustable potentiometer for adjusting the set-point voltage.

9. The motor control circuit of claim 2 wherein:

the current to-voltage converter includes:

a low pass filter.

10. An adjustable, constant pressure gun for dispensing viscous materials such as caulk and adhesive, including:

a housing including a handle and an operator-actuated trigger;

power supply terminals for receiving a source of electrical power;

a motor mounted within the housing to drive a dispensing mechanism;

an electronic switch mounted within the housing and connected between the power supply terminals and motor, for controlling the flow of current through the motor;

an operator-adjustable pressure control mounted within the housing and connected to the power supply terminals, for providing a set-point pressure signal representative of a desired dispensing pressure;

a load monitor circuit mounted within the housing and coupled to the motor, for providing a feedback pressure signal representative of the actual dispensing pressure as a function of the load on the motor;

a comparator mounted within the housing and connected to the switch, pressure control and load monitor circuit, for comparing the feedback pressure signal to the set-point pressure signal and controlling the switch as a function of the comparison to maintain the actual dispensing pressure within a predetermined operating pressure band of the desired dispensing pressure.

11. The gun of claim 10 wherein:

the pressure control includes:

an operator-adjustable potentiometer for adjusting the set-point voltage.

12. The gun of claim 11 wherein:

the load monitor circuit includes:

a current-to-voltage converter coupled to the motor for providing a feedback pressure voltage signal representative of the current drawn by the motor;

the pressure control includes:

an operator-adjustable reference voltage source for providing a set-point voltage signal representative of the desired dispensing pressure; and the comparator compares the feedback pressure voltage signal to the set-point voltage signal, and controls the electronic switch as a function of the comparison.

13. The gun of claim 12 wherein:

the comparator includes:

means for turning on the electronic switch to allow current flow through the motor when the feedback pressure voltage signal is less than the set-point voltage signal; and means for turning off the electronic switch to prevent current flow through the motor when the feedback pressure voltage signal is greater than the set-point voltage signal.

14. The gun of claim 13 wherein:

the electronic switch is connected between the motor and the comparator.

15. The gun of claim 14 wherein:

the comparator includes:

a hysteresis comparator.

16. The gun of claim 15 wherein:

the hysteresis comparator includes:

an operational amplifier having an output terminal connected to the electronic switch, a noninverting input terminal connected to the pressure control to receive the set-point voltage signal, and an inverting input terminal connected to the current-to-voltage converter to receive the feedback pressure voltage signal; and positive feedback circuitry connected between the output and input terminals of the operational amplifier and cooperating with the pressure control to establish the operating pressure band.

17. The gun of claim 12 wherein:

the current-to-voltage converter includes:

a low pass filter.

18. An adjustable, battery-powered, constant pressure gun for dispensing viscous materials such as caulk and adhesive, including:

a gun housing including a handle and an operator-actuated trigger;

a trigger switch mounted within the housing and responsive to actuation of the trigger;

a battery compartment and power supply terminals in the housing, adapted for receiving batteries to power the gun;

a motor mounted within the housing to drive a dispensing mechanism;

an electronic switch mounted within the housing and connected between the power supply terminals and motor, for controlling the flow of current through the motor;

an operator-adjustable pressure control mounted within the housing and coupled to the power supply terminals, for providing a set-point voltage signal representative of a desired dispensing pressure;

a current-to-voltage converter including a low-pass filter mounted within the housing and coupled to the motor, for providing a feedback pressure signal representative of the actual dispensing pressure as a function of the current drawn by the motor;

a hysteresis comparator mounted within the housing and connected to the switch, pressure control and current-to-voltage converter, for comparing the feedback pressure signal to the set-point signal when the trigger switch is actuated by the trigger, and for controlling the switch as a function of the comparison to maintain the actual dispensing pressure within a predetermined operating band of the desired dispensing pressure.

* * * * *

UNITED STATES PATENT AND TRADEMARK OFFICE

CERTIFICATE OF CORRECTION

PATENT NO. : 5,556,009

DATED : September 17, 1996

INVENTOR(S) : Andrew R. Motzko

It is certified that error appears in the above-indentified patent and that said Letters Patent is hereby corrected as shown below:

Column 10, line 55, delete "11" and insert therefor --10--.

Signed and Sealed this

Twenty-fourth Day of December, 1996

*Attest:*

Bruce Lehman

BRUCE LEHMAN

*Attesting Officer*

*Commissioner of Patents and Trademarks*